United States Patent [19]

Kurahashi et al.

[11] 4,168,687

[45] Sep. 25, 1979

[54] FUEL PUMP FOR AN INTERNAL COMBUSTION ENGINE HAVING A CARBURETOR

[75] Inventors: Yasuo Kurahashi; Takayuki Yoshimura; Takashi Miyake, all of Toyota; Hidenori Tateno, Aichi, all of Japan

[73] Assignee: Toyota Jidosha Kogyo Kabushiki Kaisha, Aichi, Japan

[21] Appl. No.: 873,602

[22] Filed: Jan. 30, 1978

[30] Foreign Application Priority Data

Nov. 4, 1977 [JP] Japan ..... 52/132924

[51] Int. Cl.[2] ..... F02M 37/20

[52] U.S. Cl. ..... 123/136; 123/139 AV; 261/34 R

[58] Field of Search ..... 123/136, 139 AV; 261/34 R; 55/159

[56] References Cited

U.S. PATENT DOCUMENTS

| | | | |
|---|---|---|---|
| 984,032 | 2/1911 | Seager | 123/136 |
| 1,323,415 | 12/1919 | Sherbondy | 123/139 AV |
| 2,323,525 | 7/1943 | Ebel et al. | 123/136 |
| 2,965,088 | 12/1960 | Coffey | 123/136 |

*Primary Examiner*—Charles J. Myhre
*Assistant Examiner*—Andrew M. Dolinar
*Attorney, Agent, or Firm*—Stevens, Davis, Miller & Mosher

[57] ABSTRACT

A fuel pump for an internal combustion engine including a casing wherein partition walls divide the upper space of said casing into a fuel drawing chamber receiving fuel from a fuel tank, a fuel chamber discharging the fuel to a carburetor and a vapor separating chamber communicating with the fuel tank. A space between the fuel chamber and the vapor separating chamber enables the communication of the fuel chamber with the vapor separating chamber, so that a large portion of the vapor produced in the fuel chamber removes to the vapor separating chamber and can be returned to the fuel tank, with the result that fuel substantially free from vapor can be supplied to the carburetor.

5 Claims, 7 Drawing Figures

FUEL PUMP FOR AN INTERNAL COMBUSTION ENGINE HAVING A CARBURETOR

This invention relates to a fuel pump for motor vehicles. Conventionally, the fuel system of a motor vehicle has a return port provided at the fuel discharging chamber of the fuel pump or at the inlet of the carburetor. The return port communicates with the fuel tank through the return line and a portion of the fuel pumped by the fuel pump is returned therethrough to the fuel tank. The amount of fuel returning is adjusted by means of a throttle provided at the return port or at the return line. Such returning of a portion of the fuel results in a certain amount of fuel continually flowing through the fuel lines even when a small amount of fuel is being consumed, e.g., at the time of engine idling, so that the fuel lines and the fuel pump are not overheated, resulting in the prevention of production of vapor. If a large amount of vapor is produced in the fuel lines, however, the fuel system is "vaporlocked", so that the discharge ability of the fuel pump is extremely lowered which makes impossible smooth operation of the engine.

In such a fuel return system, when a large amount of vapor is produced in the fuel system due to high temperatures, only a portion of the vapor can be returned to the fuel tank and the large remaining portion thereof, together with the liquid fuel, is discharged to the mixture line of the carburetor. This results in the explosive mixture being too thick which will make the engine operation unstable.

An object of this invention is to provide a fuel pump which possesses an excellent vapor separating ability therein under high temperatures as well as low temperatures and is capable of supplying fuel substantially free from vapor to the carburetor.

Another object of this invention is to provide a fuel pump which ensures the stable operation of the engine by preventing the supply of an explosive mixture which is too thick to the cylinder and is capable of decreasing the discharge of unburned gas from the engine.

A further object of this invention is to provide a fuel pump which has such abilities as above mentioned and yet is of simple construction.

Further objects and advantages of this invention will become apparent from the following description and accompanying drawings, wherein.

Figure 6:
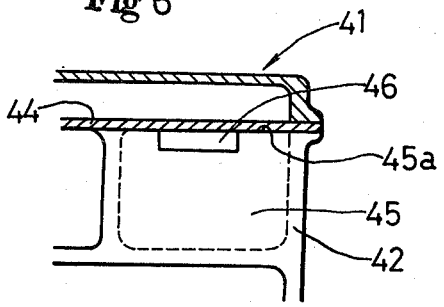
Figure 7:
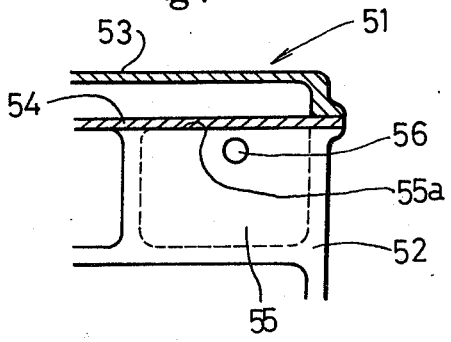

FIGS. 6 and 7 each show a portion of a further embodiment of this invention.

Figure 1:
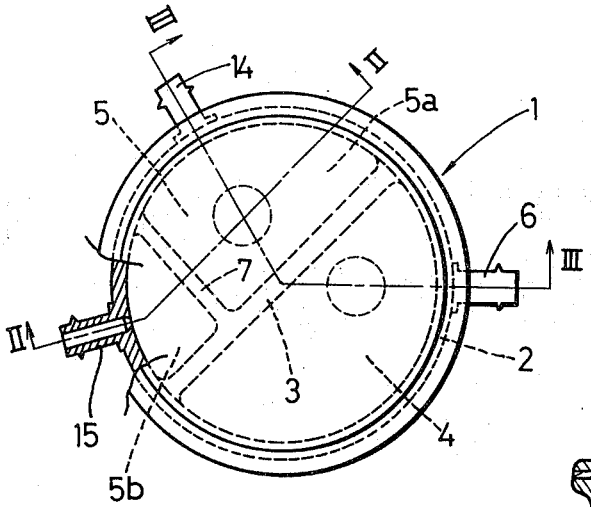
FIG. 1 is a partially cutaway plan view of a fuel pump according to this invention.
Figure 2:
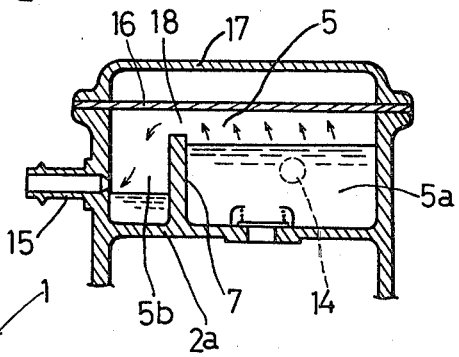
FIG. 2 is a cross sectional view of the fuel pump shown in FIG. 1, taken on line II—II.
Figure 3:
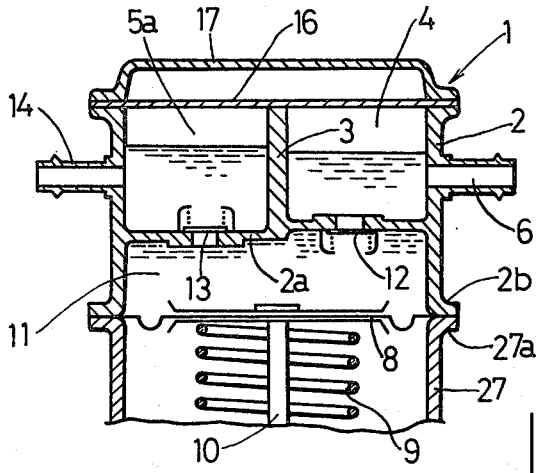
FIG. 3 is a cross sectional view of the fuel pump shown in FIG. 1, taken on line III—III.
Figure 4:
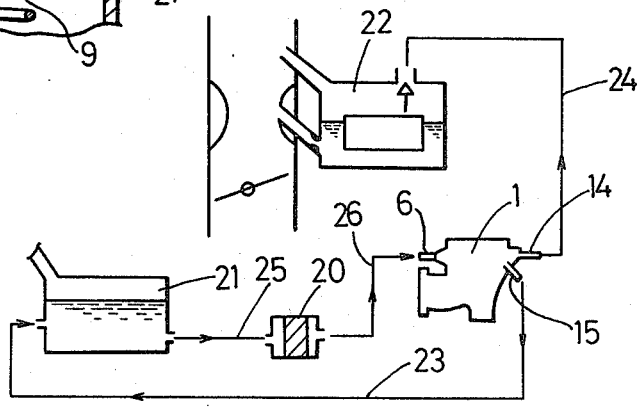
FIG. 4 shows a fuel system employing the fuel pump shown in FIG. 1.

Referring now to the drawings, FIG. 1 illustrates a fuel pump 1 including a cylindrical casing 2 having open ends and a floor section 2*a* located somewhat below the middle portion of the casing 2. A cap 17 is attached to the casing 2 with a gasket 16 being present therebetween. In the casing 2, the upper space formed by the floor section 2*a* is divided by a radially extending partition wall 3 into a fuel drawing chamber 4 and a fuel discharge chamber 5. The fuel discharge chamber 5 is further divided into a fuel chamber 5*a* and a vapor separating chamber 5*b* by means of another partition wall 7. The partition wall 3 is flush with the upper surface of the casing 2. The fuel drawing chamber 4 has an inlet port 6 communicating with a fuel tank 21 by way of a fuel line 26, a fuel filter 20 and a fuel line 25. The fuel chamber 5*a* has a larger volume than the vapor separating chamber 5*b* as shown in FIGS. 1 and 2 and has an outlet port 14 communicating with a carburetor 22 through a fuel line 24. The vapor separating chamber 5*b* has a return port 15 communicating with the fuel tank 21 through a return line 23. The casing 2 has a flange 2*b* at its lower end and is connected to another casing 27 having a flange 27*a*. A diaphragm 8 is provided between the casings 2 and 27. To the diaphragm 8 is attached the upper end of a rod 10 which is reciprocated axially by means of a locking arm (not shown) actuated by the engine and a spring 9. Between the diaphragm 8 and the floor section 2*a* is a pump chamber 11. The bottom of the fuel drawing chamber 4 has a check valve 12 attached so as to open outwards, i.e., toward the pump chamber 11, while the bottom of the fuel chamber 5*a* has a check valve 13 attached so as to open inwards. As shown in FIGS. 2 and 3, the partition wall 3 is in contact with the gasket 16, while another partition wall 7 is not so, but a space 18 exists therebetween, so that the fuel chamber 5*a* can communicate with the vapor separating chamber 5*b*.

In the arrangement described above, when the rod 10 pulls the diaphragm 8 down, the fuel is drawn into the fuel drawing chamber 4 from the fuel tank 21 through the fuel line 25, fuel filter 20, fuel line 26 and inlet port 6 and flows into the pump chamber 11 with the check valve 12 being opened. When the diaphragm 8 is then moved upward by the rod 10, the check valve 13 is opened and the fuel flows up into the fuel chamber 5*a* of the fuel discharge chamber 5. In the fuel discharge chamber 5, vapor produced in the fuel chamber 5*a*, together with a portion of the fuel, removes therefrom to the vapor separating chamber 5*b* and both are returned to the fuel tank 21 through the return port 15 and return line 23. Thus made free from vapor in the fuel discharge chamber 5, the fuel is then discharged to the carburetor 22 from the fuel chamber 5*a* through the outlet port 14 and fuel line 24. It can be understood, therefore, that although vapor is further produced during flowing of the fuel through the fuel line 24, the fuel supplied to the carburetor 21 is substantially free from vapor since the vapor produced in the fuel line 24 is in a very small amount. Consequently, a not too thick explosive mixture can be made in the carburetor 22, unlike by the use of the conventional fuel pump, so that such advantages can be obtained as the stability of operation of the engine, a decrease in the exhaust of an unburned poisonous gas from the engine, or the like. The fuel pump described hereinabove can be easily manufactured since it is of simple construction as can be seen from the preceding.

Figure 5:
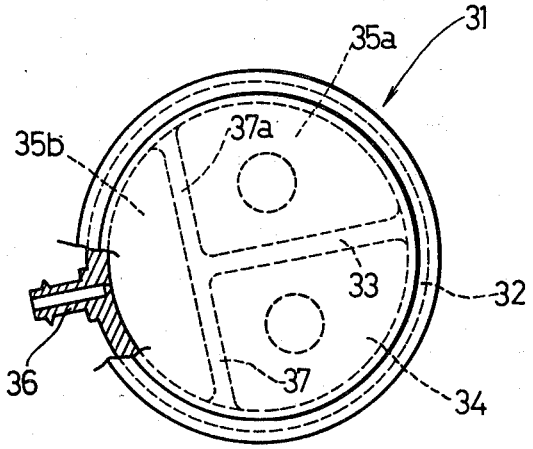
FIG. 5 is a partially cutaway plan view of a modification of the fuel pump shown in FIG. 1.

FIG. 5 illustrates another embodiment of this invention. Numeral 31 designates a fuel pump having a casing 32. As in the fuel pump of the first embodiment, the space within the casing 32 is divided into a fuel drawing chamber 34, a fuel chamber 35*a*, a vapor separating chamber 35*b* and a pump chamber (not shown). Unlike in the first embodiment, however, the vapor separating chamber 35*b* has a larger volume than the vapor separating chamber 5*b* of the first embodiment, so that the former 35*b* has a higher vapor separating ability than the latter 5*b*. Between a portion 37*a* of the partition wall 37 which divides the fuel chamber 35*a* and vapor separating chamber 35*b* and a gasket (not shown) similar to that of the first embodiment exists a space which allows the communication of the fuel chamber 35*a* with the vapor separating chamber 35*b* so that vapor produced in the fuel chamber 35*a* can flow to the latter.

FIG. 6 illustrates a further embodiment of this invention. Numeral 41 designates a fuel pump having a casing 42. Corresponding to the partition wall 7 in the first embodiment, a partition wall 45 divides a fuel chamber and a vapor separating chamber (not shown). With a cut at 46, the partition wall 45 is in contact a gasket 44, so that the cut 46 serves as a communicating space between the fuel chamber and the vapor separating chamber which enables vapor produced in the fuel chamber to flow to the vapor separating chamber. The amount of cut or space 46 is smaller than that of the space 18 in the first embodiment, so that a smaller amount of fuel, together with the vapor, removes from the fuel chamber to the vapor separating chamber than in the first embodiment, resulting in an increase of the vapor separating ability of the vapor separating chamber. The cut 46 can be easily made.

FIG. 7 illustrates a further embodiment of this invention. Numeral 51 designates a fuel pump having a casing 52. Corresponding to the partition wall 7 in the first embodiment, a partition wall 55 divides a fuel chamber and a vapor separating chamber (not shown). Although the partition wall 55 is in contact with a gasket 54 at its entire upper surface, the fuel chamber can communicate with the vapor separating chamber because of the presence of a hole 56 made through the partition wall 55 near the top thereof, so that vapor produced in the fuel chamber can flow to the vapor separating chamber. The communicating hole 56 can be easily made.

It will be understood that further modifications may be made in the above-described fuel pumps without departing from the spirit of this invention.

What we claim is:

1. A fuel pump for use in an internal combustion engine having a carburetor which draws fuel from a fuel tank and discharges the fuel to the carburetor by means of a diaphragm attached to the lower end of the pump so as to travel with a rod movable in conjunction with operation of the engine, said pump comprising:

a substantially vertically disposed cylindrical casing;

a substantially horizontal floor section extending transversely across the casing at a position slightly below the middle thereof and dividing it into upper and lower spaces, said lower space defining a pump room;

a first substantially vertically disposed partition wall extending upwardly in the upper space from the floor section and transversely across the casing and dividing the upper space into a fuel drawing chamber, in fluid communication with the fuel tank, and a fuel discharge chamber;

a first check valve attached to the floor section for fluidly communicating the pump room and the fuel drawing chamber, said first check valve being openable only towards the pump room;

a second substantially vertically disposed partition wall extending upwardly in the upper space from the floor section and partly transversely across the casing from a section of the first wall intermediate the ends thereof to the casing, said second wall dividing said fuel discharge chamber into a fuel flow chamber, in fluid communication with the carburetor, and a vapor separating chamber in fluid communication with the fuel tank;

a second check valve attached to the floor section for fluidly communicating the pump room and the fuel flow chamber, said second check valve being openable only towards the fuel flow chamber;

a gasket extending across the upper end of the casing;

a cap on said gasket;

said gasket being between the cap and the upper end of the casing to seal the upper end of the casing;

the upper end of said first partition wall being substantially flush with the upper end of the casing and being in direct contact with the gasket throughout the transverse extent of said first wall to completely separate the fuel drawing chamber and the fuel discharge chamber; and the upper end of the second partition wall is vertically spaced from the gasket and defines with said gasket a means for fluid communication between the fuel flow chamber and the vapor separating chamber.

2. A fuel pump for use in an internal combustion engine having a carburetor which draws fuel from a fuel tank and discharges the fuel to the carburetor by means of a diaphragm attached to the lower end of the pump so as to travel with a rod movable in conjunction with operation of the engine, said pump comprising:

a substantially vertically disposed cylindrical casing;

a substantially horizontal floor section extending transversely across the casing at a position slightly below the middle thereof and dividing it into upper and lower spaces, said lower space defining a pump room;

a first substantially vertically disposed partition wall extending upwardly in the upper space from the floor section and transversely across the casing and dividing the upper space into a fuel drawing chamber, in fluid communication with the fuel tank, and a fuel discharge chamber;

a first check valve attached to the floor section for fluidly communicating the pump room and the fuel drawing chamber, said first check valve being openable only towards the pump room;

a second substantially vertically disposed partition wall extending upwardly in the upper space from the floor section and partly transversely across the casing from a section of the first wall intermediate the ends thereof to the casing, said second wall dividing said fuel discharge chamber into a fuel flow chamber, in fluid communication with the carburetor, and a vapor separating chamber in fluid communication with the fuel tank;

a second check valve attached to the floor section for fluidly communicating the pump room and the fuel flow chamber, said second check valve being openable only towards the fuel flow chamber;

a gasket extending across the upper end of the casing;

a cap on said gasket;

said gasket being between the cap and the upper end of the casing to seal the upper end of the casing;

the upper end of said first partition wall being substantially flush with the upper end of the casing and being in direct contact with the gasket throughout the transverse extent of said first wall to completely separate the fuel drawing chamber and the fuel discharge chamber; and the upper end of said second partition wall also being substantially flush with the upper end of the casing and in direct contact with the gasket over at least a part of its transverse extent, and means defined in said second partition wall for fluidly communicating said fuel flow chamber and said vapor separating chamber.

3. The invention of claim 2 wherein the upper end of said second partition wall has an upwardly open opening therethrough and is in direct contact with said gasket throughout the transverse extent of said second wall other than at the opening.

4. The invention of claim 2 wherein the upper end of said second partition wall is in direct contact with the gasket throughout the transverse extent of said second wall and said defined means comprises a hole through the second wall near the upper end thereof.

5. The invention of claim 1, 2, 3 or 4 wherein the volume of said vapor separating chamber is smaller than that of said fuel flow chamber.

* * * * *